United States Patent [19]

Hirota et al.

[11] Patent Number: 4,992,765

[45] Date of Patent: Feb. 12, 1991

[54] ELECTROMAGNETIC CONTACTOR

[75] Inventors: Takato Hirota; Kuniyuki Kogawa; Shigeaki Otake, all of Kanagawa, Japan

[73] Assignee: Fuji Electric Co., Ltd., Kanagawa, Japan

[21] Appl. No.: 390,548

[22] Filed: Aug. 8, 1989

[30] Foreign Application Priority Data

Aug. 10, 1988 [JP] Japan ..... 63-105848[U]
Apr. 12, 1989 [JP] Japan ..... 1-42589[U]

[51] Int. Cl.[5] ..... H01H 67/02
[52] U.S. Cl. ..... 335/131; 335/202
[58] Field of Search ..... 335/131-133, 335/202

[56] References Cited

U.S. PATENT DOCUMENTS 3,197,583 7/1965 Goodwin, Jr. et al. ..... 200/50 B
3,280,280 10/1966 Gryctko ..... 200/50 B

FOREIGN PATENT DOCUMENTS 62-123623 6/1987 Japan .

*Primary Examiner*—Leo P. Picard
*Assistant Examiner*—Lincoln Donovan
*Attorney, Agent, or Firm*—Finnegan, Henderson, Farabow, Garrett and Dunner

[57] ABSTRACT

An electromagnetic contactor includes an engaging portion formed on a side surface of its body and disposed below a coil terminal. An attachment is releasably attached to the body of the electromagnetic contactor. The attachment includes a casing containing an electric component, the casing having a resilient projection formed on a side surface thereof. The resilient projection is resiliently engageable releasably with the engaging portion. The attachment has a plate-like connecting element projecting outwardly from the casing. The connecting element is connectable with the coil terminal when the attachment casing is attached to the body of the electromagnetic contactor.

9 Claims, 2 Drawing Sheets

ELECTROMAGNETIC CONTACTOR

BACKGROUND OF THE INVENTION

1. Field of the Invention

This invention relates generally to an electromagnetic contactor, and more particularly to a construction for mounting an attachment or accessory, containing additional function-performing electric components such as a surge-suppressing element and an operation-indicating lamp, to the body of the electromagnetic contactor. Preferably, such attachment can be removably attached to the electromagnetic contactor even after the electromagnetic contactor has been connected to a switchboard.

2. Prior Art

In order that an attachment can be releasably attached to an electromagnetic contactor even after the electromagnetic contactor has been connected to a switchboard, there has been known an electromagnetic contactor which has a first engaging portion formed on the surface of a side wall thereof, and an attachment casing which also has a second engaging portion which is resiliently engageable with the first engaging portion, thereby attaching the attachment to the electromagnetic contactor by one touch.

With such a conventional arrangement, the attachment can be easily attached to the electromagnetic contactor; However, whether the attachment is attached to the electromagnetic contactor in intimate contact therewith or not depends on the condition of engagement between the first and second engaging portions. Generally since the electromagnetic contactor is subjected to vibration each time it is operated, a considerable burden is imposed on lead wires extending from the attachment to the electromagnetic contactor if the contact between the attachment and the electromagnetic contactor is not sufficiently intimate. Moreover, in the worst case, the attachment is disengaged from the electromagnetic contactor. Further, connecting elements of the attachment are not electrically insulated. In order to provide a good electrical insulation between the connecting elements and the electromagnetic contactor, it has been required to provide an adequate distance between the electromagnetic contactor and the attachment. This results in a problem that the resultant assembly composed of the electromagnetic contactor and the attachment fails to be of a compact-size. Further, there is a risk that some object may be brought into contact with the connecting elements.

SUMMARY OF THE INVENTION

It is therefore an object of this invention to provide an electromagnetic contactor which overcomes the above deficiencies with the prior art, and enables a firm and positive connection of an attachment to the electromagnetic contactor, and enables the attachment to be easily attached releasably to the electromagnetic contactor even after the electromagnetic contactor has been connected to a switchboard, and if necessary, can provide a sufficient insulation between the electromagnetic contactor and the attachment.

According to the present invention, there if provided an electromagnetic contactor comprising: a body; at least one coil terminal provided on a side surface of the body; and engaging portion formed on the side surface and disposed below the coil terminal; and an attachment releasably attached to the body of the electromagnetic contactor, the attachment including a casing containing an electric component, the casing having a resilient projection formed on a side surface thereof, the resilient projection being resiliently engageable releasably with the engaging portion of the body, the attachment having at least one plate-like connecting element projecting outwardly from the casing, the connecting element being connectable with the coil terminal. Preferably, the plate-like connecting element is covered with an electrically-insulative material except for that portion of the connecting element connectable with the coil terminal.

With this construction, the attachment can be easily releasably attached to the electromagnetic contactor by resiliently engaging the engaging projection of the attachment with the engaging portion of the electromagnetic contactor. At this time, the plate-like connecting element is connected to the coil terminal and then is fastened thereto by a terminal screw. For removing the attachment from the electromagnetic contactor, the terminal screw is loosened, and the attachment body is pulled away from the electromagnetic contact.

If the electrically-insulative material covering the connecting element is used, the insulating distance between the electromagnetic contactor and the attachment can be reduced, so that the assembly composed of the electromagnetic contactor and the attachment can be of a compact size.

BRIEF DESCRIPTION OF THE DRAWINGS

FIG. 8 is attached.

DETAILED DESCRIPTION OF THE PREFERRED EMBODIMENTS

The invention will now be described with referenced to the drawings.

Figure 1:
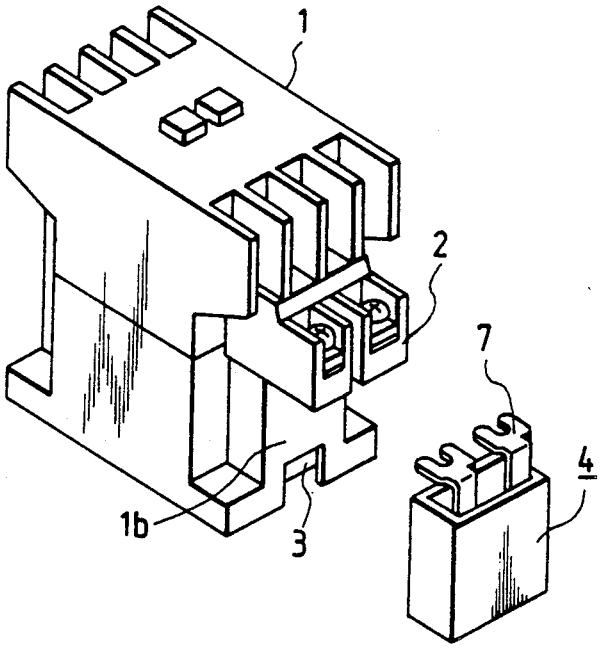
FIG. 1 is a perspective view, showing an electromagnetic contactor and its attachment according to the present invention.
Figure 2:
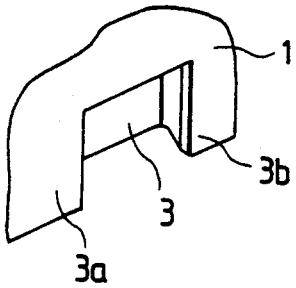
FIG. 2 is an enlarged perspective view partially showing an engaging portion of the electromagnetic contactor of FIG. 1.
Figure 4:
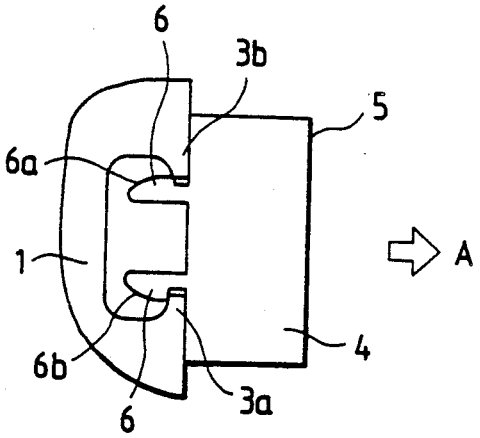
FIG. 4 is a plan view showing the engagement of the engaging portion with resilient prongs.

Referring to FIG. 1, an electromagnetic contactor 1 includes a body, a coil terminal portions 2 formed on one side surface of the body. A first engaging portion 3 is provided on the one side surface below the coil terminal portions 2, the first engaging portion 3 being formed by a recess which is formed in the one side surface of the contactor body. The first engaging portion 3 has a pair of opposed engaging projections 3*a* and 3*b*, as best shown in FIGS. 2 and 4.

An attachment 4 comprises a casing 5 containing a surge-suppressing element, an operation-indicating lamp, etc., the attachment casing 5 being made of a thermoplastic resin.

Figure 3:
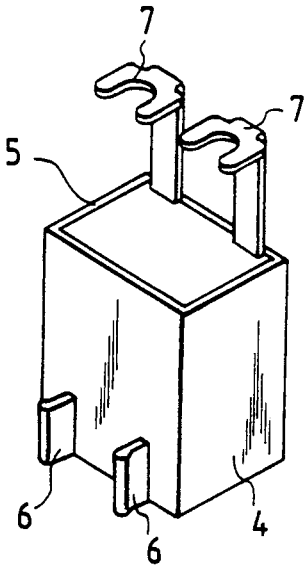
FIG. 3 is an enlarged perspective view of the attachment of FIG. 1.

As shown in FIG. 3, a pair of opposed resilient prongs 6 and 6 are formed integrally on one side surface of the attachment casing 5. Plate-like connecting elements 7 and 7 are formed on an upper surface of the attachment casing 5 and are connected to the electric components contained in the casing 5. The distance between the oppositely-directed outer surfaces of the pair of resilient prongs 6 and 6 is generally equal to the distance between the pair of engaging projections 3*a* and 3*b*.

The attachment casing 5 is attached to the electromagnetic contactor 1 below the coil terminal portions 2 in a manner shown in FIG. 4. More specifically, first, the resilient prongs 6 and 6 are brought into contact with the engaging projections 3*a* and 3*b*, respectively. Then, the attachment casing 5 is urged against the electromagnetic contactor 1, so that the resilient, prongs 6 and 6 are resiliently deformed inwardly (i.e., toward each other. When inclined surfaces 6*a* and 6*a* of the resilient prongs 6 and 6 pass past the engaging projections 3*a* and 3*b*, respectively, the resilient prongs 6 and 6 are fully fitted in the engaging portion 3, and at this time the resilient prongs 6 and 6 are returned to their original condition. Thus, the attachment casing 5 is attached to the electromagnetic contactor 1 in intimate contact therewith.

Figure 5:
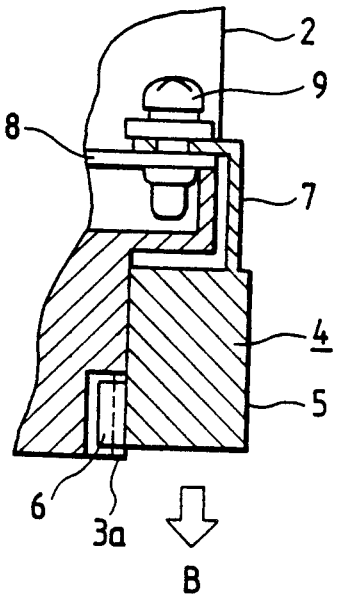
FIG. 5 is a cross-sectional view showing the connection between the electromagnetic contactor and the attachment.

In this condition, the movement of the attachment casing 5 from the electromagnetic contactor 1 in a direction of an arrow A (FIG. 2) is prevented by the resilient prongs 6 and 6. When the resilient prongs 6 and 6 are fitted in the engaging portion 3, the distal end of each of the connecting elements 7 and 7 is interposed between a coil terminal 8 of the coil terminal portion 2 and a head of a terminal screw 9, as shown in FIG. 5. Therefore, the attachment casing 5 is prevented from moving from the electromagnetic contactor 1 in a direction of an arrow B (FIG. 5) even if the terminal screws 9 are not tightened.

Figure 6:
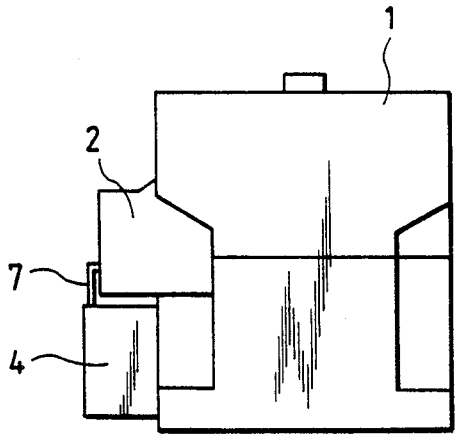
FIG. 6 is a side view of the electromagnetic contactor to which the attachment is attached.

The distal end of each connecting element 7 is notched to have a fork-shape or bifurcated shape. Therefore, even if the terminal screws 9 are not removed from the coil terminals 8, the attachment casing 5 can be attached to the electromagnetic contactor 1 merely by loosening the terminal screws 9. Thus, as shown in FIG. 6, the attachment casing 5 can be attached to the electromagnetic contactor 1 in intimate contact therewith. For removing the attachment casing 5 from the electromagnetic contactor 1, the terminal screws 9 are loosened, and then the attachment casing 5 is pulled by the fingers away from the electromagnetic contactor 1, so that the resilient prongs 6 and 6 are resiliently deformed and are disengaged from the engaging projections 3*a* and 3*b*, thus achieving the removal.

Figure 7:
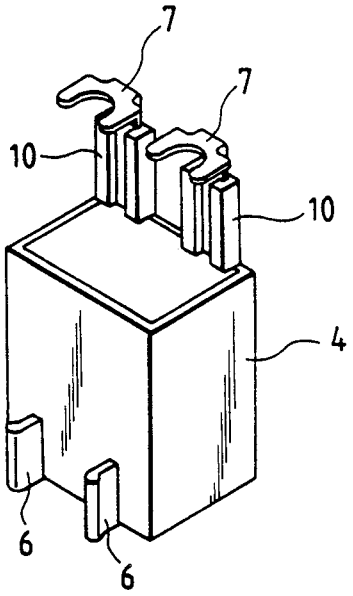
FIG. 7 is a perspective view of a modified attachment.
Figure 8:
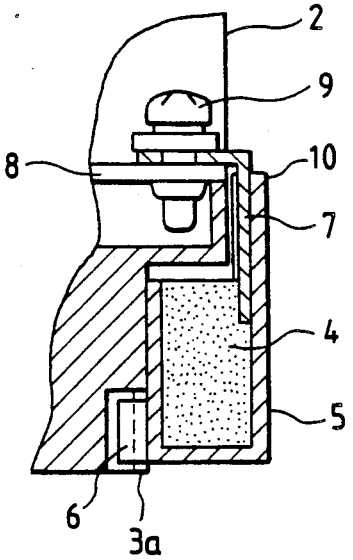
FIG. 8 is a perspective view of another modified attachment.
Figure 9:
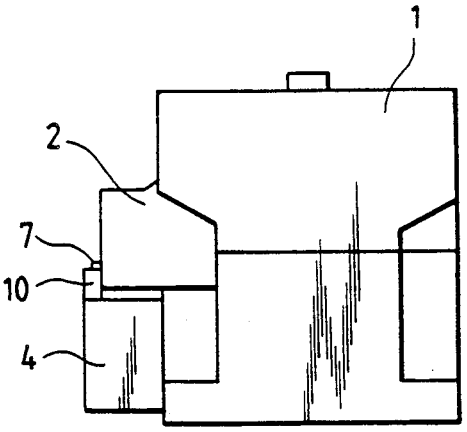
FIG. 9 is a side view of the electromagnetic contactor to which the attachment of FIG. 7

FIGS. 7 to 9 show modified forms of the invention.

In these embodiment, an electromagnetic contact 1 is of the same construction as that of the preceding embodiment of FIGS. 1 to 6, and therefore will not be described here. These modified embodiments differ from the preceding embodiment in that the connecting elements 7 and 7 are covered by electrically-insulative members 10 and 10, respectively.

As shown in FIG. 7, such electrically-insulative members 10 and 10 are separate and are mounted on and cover body portions of the connecting elements 7 and 7 except for their bifurcated distal ends.

As shown in FIG. 8, the electrically-insulative members 10 and 10 may be formed integrally with the attachment casing 5. In these modified embodiments, when the attachment casing 5 is to be attached to the electromagnetic contactor 1, the resilient prongs 6 and 6 are pressed against the engaging projections 3*a* and 3*b* of the electromagnetic contactor 1 to be fitted in the engaging portion 3, as described above with reference to FIG. 4. Thus, the attachment case 5 can be attached to the electromagnetic contactor 1 as shown in FIG. 9. The removal of the attachment casing 5 from the electromagnetic contactor 1 can be done in the same manner as described above for the preceding embodiment of FIGS. 1 to 6.

As described above, according to the present invention, the engaging portion is formed on the side surface of the body of the electromagnetic contactor and is disposed below the coil terminal portions. The resilient pawls engageable with the engaging portion are formed on the attachment casing, and the connecting elements for connection with the respective coil terminals project from the outer surface of the attachment casing. With this construction, the attachment can be easily attached to the electromagnetic contactor by one touch. Since an electrical connection between the attachment and the electromagnetic contactor is made by the connecting elements, the use of lead wires is unnecessary. Therefore, time and labor for connecting such lead wires between the attachment and the electromagnetic contactor is saved.

Further, the attachment casing is also secured to the electromagnetic contactor by the plate-like connecting elements. Therefore, advantageously the attachment casing can be positively fixed to the electromagnetic contactor. Further, by electrically insulating the connecting elements, the insulating distance between the electromagnetic contact and the attachment casing can be reduced, which enables a compact-size assembly composed of the electromagnetic contactor and the attachment.

By forming the electrically-insulative members of the connecting elements integrally with the attachment casing, the electromagnetic contactor and the attachment casing can be assembled into the unit more easily.

What is claimed is:

1. An electromagnetic contactor with an attachment, comprising:

a body having a side surface;

at least one terminal provided on the side surface of the body;

at least one engaging portion formed on the side surface and disposed below the at least one terminal; and an attachment releasably attachable to the body, the attachment including a casing containing an electric component and at least one plate-like connecting element projecting outwardly from the casing;

the casing having at least one resilient projection formed on a side surface thereof, the at least one resilient projection being releasably engageable with the at least one engaging portion of the body to secure the casing to the body, the at least one plate-like connecting element being a unitary member having a first portion extending outwardly from the casing in a first direction and a second portion being connectable with the at least one terminal.

2. The electromagnetic contactor of claim 1, wherein the first portion of the at least one plate-like connecting element is covered with an electrically-insulative material.

3. The electromagnetic contactor of claim 2, wherein the electrically-insulative material is an integral portion of the casing of the attachment.

4. The electromagnetic contactor of claim 1, wherein the at least one resilient projection comprises a resilient prong.

5. The electromagnetic contactor of claim 1, wherein the second portion of the at least one plate-like connecting element is U-shaped.

6. The electromagnetic contactor of claim 5, further comprising at least one terminal screw with a head, the at least one terminal screw being attachable to the at least one terminal, the second portion of the at least one plate-like connecting element being connectable between the at least one terminal and the head of the at least one terminal screw.

7. The electromagnetic contactor of claim 1, wherein the at least one engaging portion has a pair of opposed engaging projections which define a recess.

8. The electromagnetic contactor of claim 1, wherein the second portion of the at least one plate-like connecting element is substantially orthogonal to the first portion.

9. The electromagnetic contactor of claim 1, wherein the at least one plate-like connecting element has a rectangular cross-section.

* * * * *